US009937604B2

(12) United States Patent
Serebrennikov et al.

(10) Patent No.: US 9,937,604 B2
(45) Date of Patent: Apr. 10, 2018

(54) ABRASIVE ARTICLE AND METHOD OF MAKING SAME

(71) Applicant: SAINT-GOBAIN ABRASIVES, INC., Worcester, MA (US)

(72) Inventors: Boris L. Serebrennikov, Shrewsbury, MA (US); Michael W. Klett, Holden, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 30 days.

(21) Appl. No.: 14/392,159

(22) PCT Filed: Jun. 26, 2013

(86) PCT No.: PCT/US2013/047897

§ 371 (c)(1),
(2) Date: Dec. 23, 2015

(87) PCT Pub. No.: WO2014/209299

PCT Pub. Date: Dec. 31, 2014

(65) Prior Publication Data

US 2016/0184972 A1 Jun. 30, 2016

(51) Int. Cl.

| | |
|---|---|
| ***B24D 5/16*** | (2006.01) |
| ***B24D 18/00*** | (2006.01) |
| ***B24D 99/00*** | (2010.01) |

(52) U.S. Cl.

CPC ..... *B24D 5/16* (2013.01); *B24D 18/0009* (2013.01); *B24D 99/005* (2013.01)

(58) Field of Classification Search

CPC ..... B24D 18/0009; B24D 5/16; B24D 99/005
See application file for complete search history.

(56) References Cited

U.S. PATENT DOCUMENTS 2,843,980 A 7/1958 Bernstein et al.
3,548,551 A 12/1970 Block
(Continued)

FOREIGN PATENT DOCUMENTS

EP 1053078 B2 12/1998
EP 1066134 B9 5/2002
(Continued)

*Primary Examiner* — Marc Carlson
(74) *Attorney, Agent, or Firm* — Abel Law Group, LLP; Joseph P Sullivan

(57) ABSTRACT

An abrasive article has an abrasive portion with a bond and abrasive particles. A core is mounted to the abrasive portion. The core may include a plurality of segments that are interconnected to form the core. The abrasive article may include forming a plurality of core segments; assembling the core segments into a core; and then mounting the core to the abrasive portion to form the abrasive article. Forming an abrasive article may include mixing a phenolic resin, fillers and abrasive particles to form an abrasive matrix; injecting the abrasive matrix directly into a mold, such that the abrasive matrix is injection molded into a final wheel geometry; at least partially curing the abrasive matrix while it is inside the mold; and then removing the abrasive article from the mold.

14 Claims, 1 Drawing Sheet

(56) References Cited

U.S. PATENT DOCUMENTS

| | | | | | |
|---|---|---|---|---|---|
| 4,561,863 | A * | 12/1985 | Hashimoto | B24D 3/00 | 51/295 |
| 5,079,875 | A * | 1/1992 | Unno | B24D 7/06 | 451/541 |
| 5,465,706 | A * | 11/1995 | Sawluk | B23D 61/026 | 125/15 |
| 8,033,278 | B2 * | 10/2011 | Kitajima | B24D 3/14 | 125/15 |
| 2002/0119742 | A1 * | 8/2002 | Nakagawa | B24D 5/06 | 451/542 |
| 2013/0014739 | A1 * | 1/2013 | Um | B23D 61/04 | 125/15 |

FOREIGN PATENT DOCUMENTS

| | | | | |
|---|---|---|---|---|
| EP | 1051282 | B1 | | 1/2003 |
| EP | 1706221 | B1 | | 12/2007 |
| EP | 1862286 | A1 | | 12/2007 |
| JP | 02-048175 | A | | 2/1990 |
| JP | 02048175 | A | * | 2/1990 |
| WO | 2014209299 | A1 | | 12/2014 |

* cited by examiner

ABRASIVE ARTICLE AND METHOD OF MAKING SAME

BACKGROUND OF THE INVENTION

Field of the Disclosure

The present invention relates in general to abrasive articles and, in particular, to a system, method and apparatus for an abrasive article.

Description of the Related Art

Conventional grinding wheels are made in a labor and time intensive multistep process. The mold filling requires precision placement of a reinforcing glass web and spreading of an abrasive mix to form abrasive wheels that meet the thickness and density targets for wheel balance and ultimately performance consistency. Green or uncured wheels are carefully handled to avoid asymmetrical stresses or breakages during mold stripping and/or during pre-shaping (e.g., for depressed center wheels), and/or during the wheel stacking step prior to entering the oven for curing. Improvements in forming abrasive articles continue to be of interest to address these various issues.

SUMMARY

Embodiments of a system, method and apparatus for an abrasive article are disclosed. For example, the abrasive article may comprise an abrasive portion having a bond and abrasive particles. A core may be mounted to the abrasive portion. The core may include a plurality of segments that are interconnected to form the core.

Embodiments of a method of forming an abrasive article also are disclosed. For example, the method may comprise forming an abrasive portion having a bond and abrasive particles; forming a plurality of core segments; assembling the core segments into a core; and then mounting the core to the abrasive portion to form the abrasive article.

In still other embodiments, a method of forming an abrasive article may comprise mixing a phenolic resin, fillers and abrasive particles to form an abrasive matrix; injecting the abrasive matrix directly into a mold, such that the abrasive matrix is injection molded into a final wheel geometry; at least partially curing the abrasive matrix while it is inside the mold; and then removing the abrasive article from the mold.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
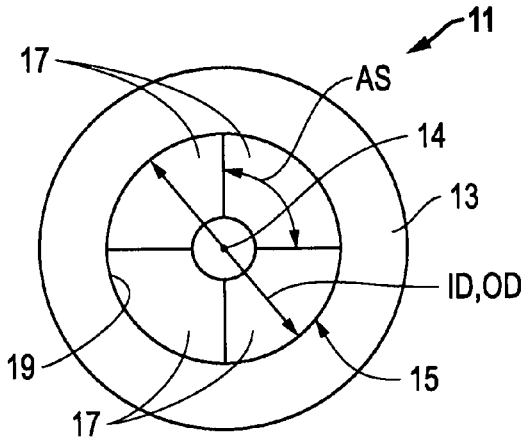
FIG. 1 is a side or axial view of embodiments of an abrasive article.
Figure 2:
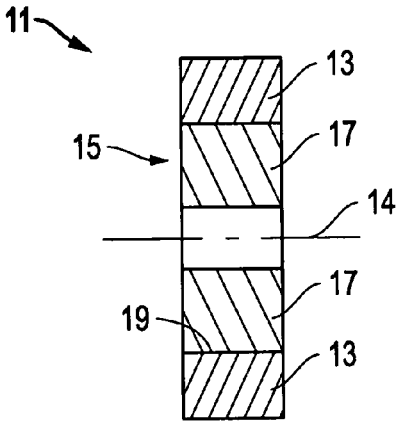
FIG. 2 is an end or radial view of embodiments of an abrasive article.

Embodiments of a system, method and apparatus for an abrasive article are disclosed. For example, as shown in FIGS. 1 and 2, the abrasive article 11 may comprise an abrasive portion 13 having a bond and abrasive particles. The abrasive portion 13 may comprise a continuous cylindrical wheel having an axis 14 as shown. In some examples, the abrasive article may comprise a polycrystalline diamond (PCD) centerless grinding wheel.

Figure 3:
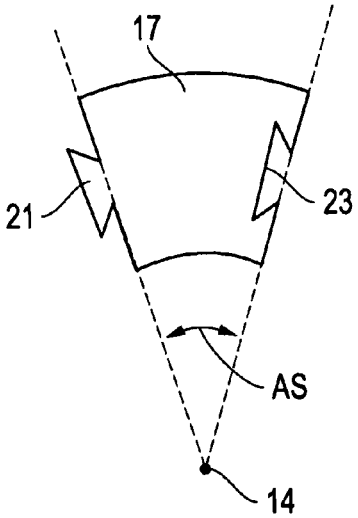
FIG. 3 is a side or axial view of embodiments of a core segment.

A core 15 may be mounted to the abrasive portion 13. The core 15 may comprise a plurality of segments 17 that are interconnected to form the core 15. The core segments 17 may be individually injection molded, as shown in FIG. 3. Each core segment 17 may extend radially from adjacent the axis 14 into contact with the abrasive portion 13, depending on the size of the central bore or hub for mounting purposes.

Embodiments of the core segments 17 may be mechanically interconnected to each other in a variety of ways. For example, as shown in FIG. 3, each core segment 17 may be provided with male and female dovetail features 21, 23, respectively, for interconnection with adjacent ones of the core segments 17 to form an assembly for the core 15. Many other types of connection methods may be used.

The core 15 may be cylindrical, and each core segment 17 may comprise an angular portion of the core. For example, each angular portion may have an angular span AS of about 10 degrees to about 180 degrees. The core segments 17 in FIG. 1 each have an AS of about 90 degrees, while those in FIG. 3 have an AS of about 30 degrees. The embodiments are not limited to these values.

Each core segment 17 may comprise one or more materials. For example, the core segments 17 may include at least one of a thermoplastic, PEEK, PEI, PI, PBT, PET, LCP filled or unfilled systems, a thermoset phenolic, wood flour, glass fiber and mineral fill. Other materials may be used.

The abrasive portion 13 may include a bore 19 with an inner diameter (ID). The core 15 may include an outer diameter (OD) that may be mounted to the ID of the abrasive portion 13. Embodiments of the abrasive portion 13 may be attached to the core 15 with at least one of a bond, mechanical attachment, an interlock and co-molding. The core 15 also may be surface mounted to the abrasive portion 13, such that the core 15 does not extend into or through the abrasive portion 13. Many other connection methods may be used.

Embodiments of a method of forming an abrasive article 11 also are disclosed. For example, the method may comprise forming an abrasive portion 13 having a bond and abrasive particles; forming a plurality of core segments 17; assembling the core segments 17 into a core 15; and then mounting the core 15 to the abrasive portion 13 to form the abrasive article 11.

The method may include molding the core segments in a single or a multi-cavity mold. The method also may include molding the core segments in a conventional horizontal or vertical injection molding machine, with or without rotary table.

In other embodiments, a method of forming an abrasive article may comprise mixing a phenolic resin, fillers and abrasive particles to form an abrasive matrix; injecting the abrasive matrix directly into a mold, such that the abrasive matrix is injection molded into a final wheel geometry; at least partially curing the abrasive matrix while it is inside the mold; and then removing the abrasive article from the mold.

The method may include fully curing the abrasive matrix while in the mold, such that the abrasive article is removed from the mold in the final wheel geometry. In some versions of the method, the abrasive matrix is not cured during mixing. The abrasive article may be injection molded directly from the abrasive matrix without intermediate handling. The abrasive matrix may comprise a fiber glass-free molding compound. The method may further comprise machining of the abrasive article after removal from the mold. In some versions, the abrasive article does not comprise a reinforcement, such as a glass web.

Some of these embodiments have the advantages of at least one of reductions in weight and cost, and improved performance and mechanical properties. The final wheel geometry can also avoid many of the previously described issues for conventional wheels. The wheel and desired geometry can be molded and either fully or partially cured in one step. This process offers consistent thickness, weight, and density control without intermittent handling that could otherwise lead to defects.

EXAMPLES

Samples of injection molded wheels were prepared using conventional, fiber glass free molding compound. The molded parts were machined into wheels having dimensions comparable to conventional 4.5 inch diameter cut-off and grinding wheels. Burst and side load and content properties are shown below in Table 1. These values were higher than anticipated considering that no reinforcements were used. Manual cut-off testing showed performance of injected molded phenolic resin comparable to conventional wheel containing the same abrasive blend and abrasive level.

TABLE 1

| | | | | | |
|---|---|---|---|---|---|
| PLENCO 02440 + 60% | 1 | 100 | 1.7 | 33661 | 26 |
| PLENCO 02440 + 60% | 2 | 100 | 1.7 | 31962 | 30 |
| PLENCO 02440 + 60% | 3 | 100 | 1.7 | 35049 | 30 |
| EN 12413 minimum | | | | 24900 | 40 |
| PLENCO 02440 + 60% | 1 | 100 | 7 | 33211 | 234 |
| PLENCO 02440 + 60% | 2 | 100 | 7 | 33398 | 236 |
| PLENCO 02440 + 60% | 3 | 100 | 7 | 32448 | 235 |
| PLENCO 02440 + 60% | 4 | 100 | 7 | 35182 | 182 |
| PLENCO 02440 + 60% | 5 | 100 | 7 | 33824 | 264 |
| EN12413 minimum | | | | 24900 | 290 |

| Property | IM PEEK | IM Phenolic | Production wheel |
|---|---|---|---|
| Density (g/cm3) | 2.75 | 2.25 | |
| Abrasive content (wt %) | 75 | 60 | 60 |
| Wheel wear (mm3) | 7749 | 2075 | 1725 |
| Steel wear (mm3) | 482 | 628 | 740 |
| G-ratlo (steel wheel) | 0.06 | 0.30 | 0.43 |
| Q-ratlo | 0.18 | 1.04 | 1.1 |

An exemplary binder system includes one or more organic resins, such as phenolic resin, boron-modified resin, nano-particle-modified resin, urea-formaldehyde resin, acrylic resin, epoxy resin, polybenzoxazine, polyester resin, isocyanurate resin, melamine-formaldehyde resin, polyimide resin, other suitable thermosetting or thermoplastic resins, or any combination thereof.

Specific, non-limiting examples of resins that can be used include the following: the resins sold by Dynea Oy, Finland, under the trade name Prefere and available under the catalog/product numbers 8522G, 8528G, 8680G, and 8723G; the resins sold by Hexion Specialty Chemicals, OH, under the trade name Rutaphen® and available under the catalog/product numbers 9507P, 8686SP, and SP223; and the resins sold by Sumitomo, formerly Durez Corporation, TX, under the following catalog/product numbers: 29344, 29346, and 29722. In an example, the bond material comprises a dry resin material.

An exemplary phenolic resin includes resole and novolac. Resole phenolic resins can be alkaline catalyzed and have a ratio of formaldehyde to phenol of greater than or equal to one, such as from 1:1 to 3:1. Novolac phenolic resins can be acid catalyzed and have a ratio of formaldehyde to phenol of less than one, such as 0.5:1 to 0.8:1.

An epoxy resin can include an aromatic epoxy or an aliphatic epoxy. Aromatic epoxies components include one or more epoxy groups and one or more aromatic rings. An example aromatic epoxy includes epoxy derived from a polyphenol, e.g., from bisphenols, such as bisphenol A (4,4'-isopropylidenediphenol), bisphenol F (bis[4-hydroxyphenyl]methane), bisphenol S (4,4'-sulfonyldiphenol), 4,4'-cyclohexylidenebisphenol, 4,4'-biphenol, 4,4'-(9-fluorenylidene)diphenol, or any combination thereof. The bisphenol can be alkoxylated (e.g., ethoxylated or propoxylated) or halogenated (e.g., brominated). Examples of bisphenol epoxies include bisphenol diglycidyl ethers, such as diglycidyl ether of Bisphenol A or Bisphenol F. A further example of an aromatic epoxy includes triphenylolmethane triglycidyl ether, 1,1,1-tris(p-hydroxyphenyl)ethane triglycidyl ether, or an aromatic epoxy derived from a monophenol, e.g., from resorcinol (for example, resorcin diglycidyl ether) or hydroquinone (for example, hydroquinone diglycidyl ether). Another example is nonylphenyl glycidyl ether. In addition, an example of an aromatic epoxy includes epoxy novolac, for example, phenol epoxy novolac and cresol epoxy novolac. Aliphatic epoxy components have one or more epoxy groups and are free of aromatic rings. The external phase can include one or more aliphatic epoxies. An example of an aliphatic epoxy includes glycidyl ether of C2-C30 alkyl; 1,2 epoxy of C3-C30 alkyl; mono or multiglycidyl ether of an aliphatic alcohol or polyol such as 1,4-butanediol, neopentyl glycol, cyclohexane dimethanol, dibromo neopentyl glycol, trimethylol propane, polytetramethylene oxide, polyethylene oxide, polypropylene oxide, glycerol, and alkoxylated aliphatic alcohols; or polyols. In one embodiment, the aliphatic epoxy includes one or more cycloaliphatic ring structures. For example, the aliphatic epoxy can have one or more cyclohexene oxide structures, for example, two cyclohexene oxide structures.

An example of an aliphatic epoxy comprising a ring structure includes hydrogenated bisphenol A diglycidyl ether, hydrogenated bisphenol F diglycidyl ether, hydrogenated bisphenol S diglycidyl ether, bis(4-hydroxycyclohexyl)methane diglycidyl ether, 2,2-bis(4-hydroxycyclohexyl)propane diglycidyl ether, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, di(3,4-epoxycyclohexylmethyl) hexanedioate, di(3,4-epoxy-6methylcyclohexylmethyl) hexanedioate, ethylenebis(3,4-epoxycyclohexanecarboxylate), ethanedioldi(3,4-epoxycyclohexylmethyl) ether, or 2-(3,4-epoxycyclohexyl-5,5-spiro-3,4-epoxy)cyclohexane-1,3-dioxane.

An exemplary multifunctional acrylic can include trimethylolpropane triacrylate, glycerol triacrylate, pentaerythritol triacrylate, methacrylate, dipentaerythritol pentaacrylate, sorbitol triacrylate, sorbital hexacrylate, or any combination thereof. In another example, an acrylic polymer can be formed from a monomer having an alkyl group having from 1-4 carbon atoms, a glycidyl group or a hydroxyalkyl group having from 1-4 carbon atoms. Representative acrylic polymers include polymethyl methacrylate, polyethyl methacrylate, polybutyl methacrylate, polyglycidyl methacrylate, polyhydroxyethyl methacrylate, polymethyl acrylate, polyethyl acrylate, polybutyl acrylate, polyglycidyl acrylate, polyhydroxyethyl acrylate and mixtures thereof.

Depending upon the catalyzing agents and type of polymer, the binder system can be thermally curable or can be curable through actinic radiation, such as UV radiation, to form the binder system. The binder system can also include catalysts and initiators. For example, a cationic initiator can catalyze reactions between cationic polymerizable constituents. A radical initiator can activate free-radical polymerization of radically polymerizable constituents. The initiator can be activated by thermal energy or actinic radiation. For example, an initiator can include a cationic photoinitiator that catalyzes cationic polymerization reactions when exposed to actinic radiation. In another example, the initiator can include a radical photoinitiator that initiates free-radical polymerization reactions when exposed to actinic radiation. Actinic radiation includes particulate or non-particulate radiation and is intended to include electron beam radiation and electromagnetic radiation. In a particular embodiment, electromagnetic radiation includes radiation having at least one wavelength in the range of about 100 nm to about 700 nm and, in particular, wavelengths in the ultraviolet range of the electromagnetic spectrum.

The binder system can also include other components such as solvents, plasticizers, crosslinkers, chain transfer agents, stabilizers, dispersants, curing agents, reaction mediators and agents for influencing the fluidity of the dispersion. For example, the binder system can also include one or more chain transfer agents selected from the group consisting of polyol, polyamine, linear or branched polyglycol ether, polyester and polylactone.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article, comprising:

a core assembly formed by a mechanical interconnection of a plurality of angular core segments to create an outermost, circumferential surface and a central mounting aperture about a center axis, the core assembly including at least:

a first angular core segment comprising an inner surface defining an angular portion of the central mounting aperture of the core assembly, an outer surface defining an angular portion of the outermost, circumferential surface of the core assembly, and at least one side surface radially extending between the inner surface and the outer surface: and a second angular core segment comprising an inner surface defining an angular portion of the central mounting aperture of the core assembly, an outer surface defining an angular portion of the outermost circumferential surface of the core assembly, and at least one side surface radially extending between the inner surface and the outer surface, wherein the first angular core segment and the second angular core segment are mechanically interconnected coaxially adjacent each other with the at least one side surface of the first angular core segment and the at least one side surface of the second angular core segments adjoined; and an abrasive portion overlying the outer surfaces of the first and second angular core segments of the plurality of angular core segments.

2. The abrasive article of claim 1, wherein the abrasive portion is a continuous cylindrical wheel.

3. The abrasive article of claim 1, wherein the abrasive article is a polycrystalline diamond (PCD) centerless grinding wheel.

4. The abrasive article of claim 1, wherein the plurality of angular core segments are individually injection molded.

5. The abrasive article of claim 1, wherein the abrasive article has an axis, and each of the plurality of angular core segments extends radially from the axis into contact with the abrasive portion.

6. The abrasive article of claim 1, wherein the mechanical interconnection comprises male and female dovetail features.

7. The abrasive article of claim 1, wherein the core assembly is cylindrical, each angular core segment comprises an angular portion of the core assembly, and each angular portion spans an angular range of about 10 degrees to about 180 degrees.

8. The abrasive article of claim 1, wherein the abrasive portion has a bore with an inner diameter, and wherein the inner diameter of the abrasive portion is attached to the outermost, circumferential surface of the core assembly.

9. The abrasive article of claim 1, wherein the abrasive portion is attached to the core assembly with at least one of a bond, mechanical attachment, an interlock and co-molding.

10. The abrasive article of claim 1, wherein the core assembly is surface mounted to the abrasive portion, such that the core assembly does not extend into or through the abrasive portion.

11. The abrasive article of claim 1, wherein each angular core segment comprises at least one of a thermoplastic, PEEK, PEI, PI, PBT, PET, LCP filled or unfilled systems, a thermoset phenolic, wood flour, glass fiber and mineral fill.

12. A method of forming an abrasive article comprising an abrasive portion and core assembly, the method comprising:

forming a plurality of angular core segments including:

forming a first angular core segment comprising an inner surface defining an angular portion of a central mounting aperture of the core assembly, an outer surface defining an angular portion of an outermost circumferential surface of the core assembly, and at least one side surface radially extending between the inner surface and the outer surface; and forming a second angular core segment comprising an inner surface defining an angular portion of the central mounting aperture of the core assembly, an outer surface defining an angular portion of the outermost circumferential surface of the core assembly, and at least one side surface radially extending between the inner surface and the outer surface, wherein the first core segment and the second core segment are configured to mechanically interconnect adjacent to one each other the at least one side surface of the first angular core segment and the at least one side surface of the second angular core segments adjoined;

assembling the plurality of angular core segments to form the core assembly with the central mounting aperture and the outermost circumferential surface; and forming an abrasive portion overlying the outer surfaces of the first and second core segments of the plurality of angular core segments.

13. The method of claim 12, wherein the angular core segments are molded in a single or a multi-cavity mold.

14. The method of claim 13, wherein the angular core segments are molded in a conventional horizontal or vertical injection molding machine with or without rotary table.

* * * * *